US008042901B2

(12) United States Patent
Mihara

(10) Patent No.: US 8,042,901 B2
(45) Date of Patent: Oct. 25, 2011

(54) RECORDING APPARATUS AND METHOD, AND STORAGE MEDIUM STORING PROGRAM FOR DETECTING POSITION OF RECORDING PORTION

(75) Inventor: Akira Mihara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 791 days.

(21) Appl. No.: 12/114,039

(22) Filed: May 2, 2008

(65) Prior Publication Data

US 2009/0015606 A1 Jan. 15, 2009

(30) Foreign Application Priority Data

Jul. 13, 2007 (JP) ..... 2007-184884

(51) Int. Cl.
*B41J 29/393* (2006.01)
*B41J 29/38* (2006.01)

(52) U.S. Cl. ..... 347/16; 347/19

(58) Field of Classification Search ..... 347/16, 347/19

See application file for complete search history.

(56) References Cited

U.S. PATENT DOCUMENTS 6,218,660 B1 4/2001 Hada
6,324,375 B1 * 11/2001 Hada et al. ..... 399/301

FOREIGN PATENT DOCUMENTS

| | | |
|---|---|---|
| JP | 07-177299 | 7/1995 |
| JP | 9-245154 | 9/1997 |
| JP | 2003-285517 | 10/2003 |
| JP | 11-295037 | 9/2006 |

* cited by examiner

*Primary Examiner* — Uyen Chau N Le
*Assistant Examiner* — Kajli Prince
(74) *Attorney, Agent, or Firm* — Fildes & Outland, P.C.

(57) ABSTRACT

A recording apparatus is provided. The recording component includes a plurality of recording portions arranged in a first direction and moves relatively to a recording medium at a speed V in a second direction intersecting with the first direction. The reading component reads an image recorded on the recording medium in a reading cycle T by a plurality of reading sections arranged at a predetermined pitch in the first direction. The control component controls, on the recording medium by the recording component, recordation of a detection mark having a size W in the first direction of twice or more than twice the predetermined pitch and a size L in the second direction in which $L \geqq (n+1) \cdot V \cdot T$ (where n is an integer of 1 or more) and calculate a barycenter position of the detection mark in the first direction based on a reading result of the detection mark.

20 Claims, 7 Drawing Sheets

RECORDING APPARATUS AND METHOD, AND STORAGE MEDIUM STORING PROGRAM FOR DETECTING POSITION OF RECORDING PORTION

CROSS-REFERENCE TO RELATED APPLICATION

This application is based on and claims priority under 35 USC 119 from Japanese Patent Application No. 2007-184884 filed Jul. 13, 2008.

BACKGROUND

1. Technical Field

The present invention relates to a recording apparatus, a position detecting method for a recording portion and storage medium storing a position detecting program for a recording portion.

2. Related Art

Techniques regarding reading an image by the use of a line sensor have been disclosed.

However, it has been generally difficult to accurately detect positions of a plurality of recording portions based on a result that an image recorded by the recording portions arranged in a predetermined direction is read by a reading component including a plurality of reading sections arranged in the predetermined direction.

SUMMARY OF THE INVENTION

According to an aspect of the invention, there is provided a recording apparatus. The recording apparatus includes: a recording component that includes a plurality of recording portions arranged in a first direction and moves relatively to a recording medium at a speed V in a second direction intersecting with the first direction; a reading component that reads an image recorded on the recording medium by the recording component in a reading cycle T by a plurality of reading sections arranged at a predetermined pitch in the first direction; and a control component that controls, on the recording medium by the recording component, recordation of a detection mark having a size W in the first direction of twice or more than twice the predetermined pitch and a size L in the second direction in which $L \geqq (n+1) \cdot V \cdot T$ (where n is an integer of 1 or more) and calculate a barycenter position of the detection mark in the first direction based on a reading result of the detection mark by the reading component.

BRIEF DESCRIPTION OF THE DRAWINGS

An exemplary embodiment of the present invention will be described in detail based on the following figures, wherein.

DETAILED DESCRIPTION

Figure 1:
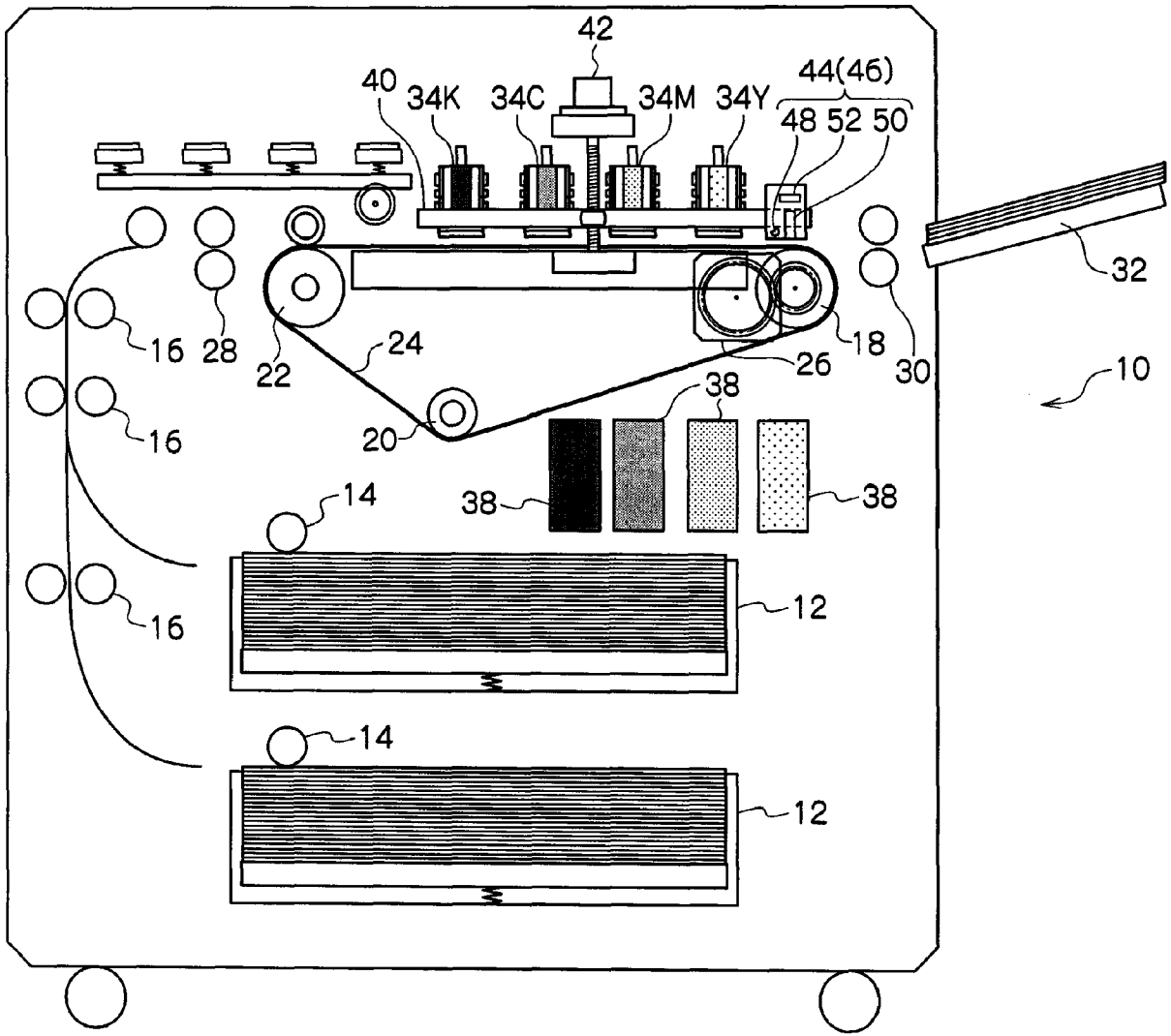
FIG. 1 is a view showing a schematic configuration of a recording apparatus in an exemplary embodiment according to the present invention.

A detailed description will be given below of an exemplary embodiment according to the invention in reference to the attached drawings. FIG. 1 shows a recording apparatus 10 in the present exemplary embodiment. In the recording apparatus 10 are housed, under inside of a housing, a plurality of sheet trays 12 capable of stacking thereon numerous recording sheets different in size from each other, respectively. Above each of the sheet trays 12 is disposed a pick-up roll 14 in contact with an uppermost one out of the recording sheets stacked on the sheet tray 12. The uppermost recording sheet in the sheet tray 12 is substantially horizontally drawn from the sheet tray 12 with the rotational drive of the corresponding pick-up roll 14 by a rotationally driving component.

A left part inside of the housing in the recording apparatus 10 in FIG. 1 shows a feed channel for the recording sheet, in which a plurality of feed rolls 16 are arranged at intervals. The feed direction of the recording sheet substantially horizontally drawn from the sheet tray 12 by the pick-up roll 14 is changed to be substantially vertical by a guide. The recording sheet is fed upward inside of the housing by the plurality of feed rolls 16 rotationally driven by the rotationally driving components, respectively. Thereafter, the feed direction of the recording sheet is changed to be substantially horizontal again by another guide.

Above the sheet trays 12 is disposed an endless conveyor belt 24 wound around a drive roll 18 and two driven rolls 20 and 22. The conveyor belt 24 is rotated together with the drive roll 18 which is rotationally driven by a drive motor 26. The drive roll 18 and the driven rolls 20 and 22 are arranged in such a manner that, in a section between the drive roll 18 and the driven roll 22, the conveyor belt 24 is horizontal at the peripheral surface thereof and is equal in height to the recording sheet whose feed direction is changed to be horizontal. Registration rolls 28 are interposed between the guide for changing the feed direction of the recording sheet to be horizontal and the driven roll 22, and further, sheet discharging rolls 30 are arranged on a side opposite to the registration rolls 28 while the conveyor belt 24 is sandwiched therebetween. As a consequence, the recording sheet whose feed direction is changed to be horizontal is horizontally fed inside of the housing by the registration rolls 28, the conveyor belt 24 and the sheet discharging rolls 30, and then, is discharged to the outside of the housing, to be thus stacked on a sheet discharge tray 32 attached to a side of the housing.

Above the arrangement position of the conveyor belt 24 are disposed recording heads 34K, 34C, 34M and 34Y serving as recording components in sequence in the feed direction of the recording sheet by the conveyor belt 24. The recording heads 34K, 34C, 34M and 34Y are recording heads for ejecting ink droplets of K (black), C (cyan), M (magenta) and Y (yellow) colors from nozzles, respectively, by an ink jet system so as to print an image on the recording sheet. Each of the recording heads 34 includes a plurality (six in an example illustrated in FIG. 2) of recording head units 36 (see FIG. 2), in which a plurality of recording portions, each having a nozzle and a mechanism for ejecting the ink droplet from the nozzle, are arranged in a predetermined direction and the plurality of nozzles are arranged at a given pitch in the predetermined direction. An alignment direction of the recording portions (i.e., the nozzles) in each of the recording head units 36 accords with a direction perpendicular to the feed direction of the recording sheet (i.e., a widthwise direction of the recording sheet), and further, the plurality of recording head units 36 are arranged in line in the widthwise direction of the recording sheet. With the above-described configuration, each of the recording heads 34 can print over the entire width of the recording sheet, and further, one line from one end to the other end in the widthwise direction of the recording sheet in one ink ejection, as is obvious from FIG. 2.

Incidentally, the mechanism for ejecting the ink droplet from the nozzle may adopt a configuration which vibrates a vibration plate by a displacement of a piezoelectric element, so as to propagate the vibration as a pressure wave inside of a pressure chamber, thus ejecting a part of ink filling the pressure chamber in the form of the ink droplet from the nozzle. In the meantime, under the arrangement position of the conveyor belt 24 are disposed four ink tanks 38 for reserving the inks of the K, C, M and Y colors therein, which are supplied to the corresponding recording heads 34 from the ink tanks 38, respectively. The recording heads 34 are fixed to one and the same support base 40, to which a head elevating mechanism 42 is mounted which can vertically move the recording heads 34 at the same time in accordance with the vertical movement of the support base 40.

Figure 2:
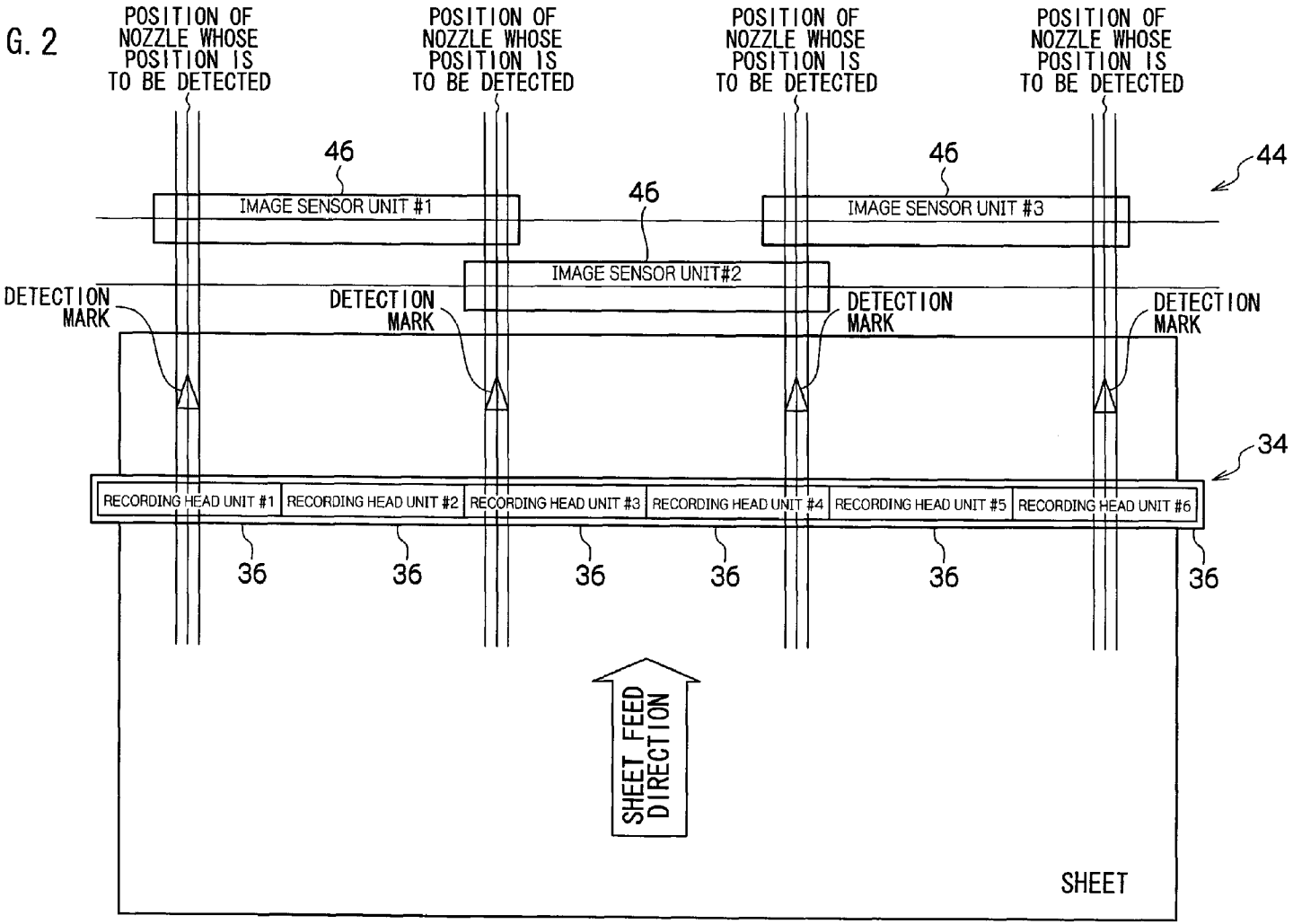
FIG. 2 is a plan view illustrating the positional interrelationship among recording head units, image sensor units and print positions of detection marks.

Moreover, onto the support base 40 is fixed an image sensor 44 downstream of the recording head 34Y in the feed direction of the recording sheet. As shown in FIG. 2, the image sensor 44 is constituted of a plurality of image sensor units 46 (three in the example illustrated in FIG. 2). As shown also in FIG. 1, each of the image sensor units 46 includes: a light source unit 48 which is constituted of a plurality of light sources consisting of LEDs or the like aligned in a predetermined direction and irradiates the recording sheet with a slit light beam in a longitudinal direction in reference to the predetermined direction; an elongated focusing lens 50 for focusing the slit light beam reflected on the recording sheet; and a CCD sensor 52 which has photoelectrically converting cells arranged in line in a predetermined direction and converts the slit light beam focused by the focusing lens 50 into an electric signal (i.e., a reading signal) by each of the photoelectrically converting cells, so as to output the electric signal. Some of the image sensor units 46 are displaced by a predetermined distance in the feed direction of the recording sheet such that the predetermined direction (i.e., the longitudinal direction of the light source and the alignment direction of the CCD cells) in the image sensor unit 46 accord with the widthwise direction of the recording sheet, and further, ranges read by the image sensor units 46 in the widthwise direction of the recording sheet partly overlap each other (see FIG. 2).

The image sensor 44 repeatedly reads a change in concentration of an image or the like on the recording sheet in a predetermined image reading cycle by the use of the plurality of image sensor units 46, and thereafter, outputs reading results as reading signals in sequence in the predetermined image reading cycle. In the present exemplary embodiment, the pitch of the arrangement of the photoelectrically converting cells in the widthwise direction of the recording sheet in the image sensor 44 is greater than that of the arrangement of the nozzles in the widthwise direction of the recording sheet in the recording head 34.

Figure 3:
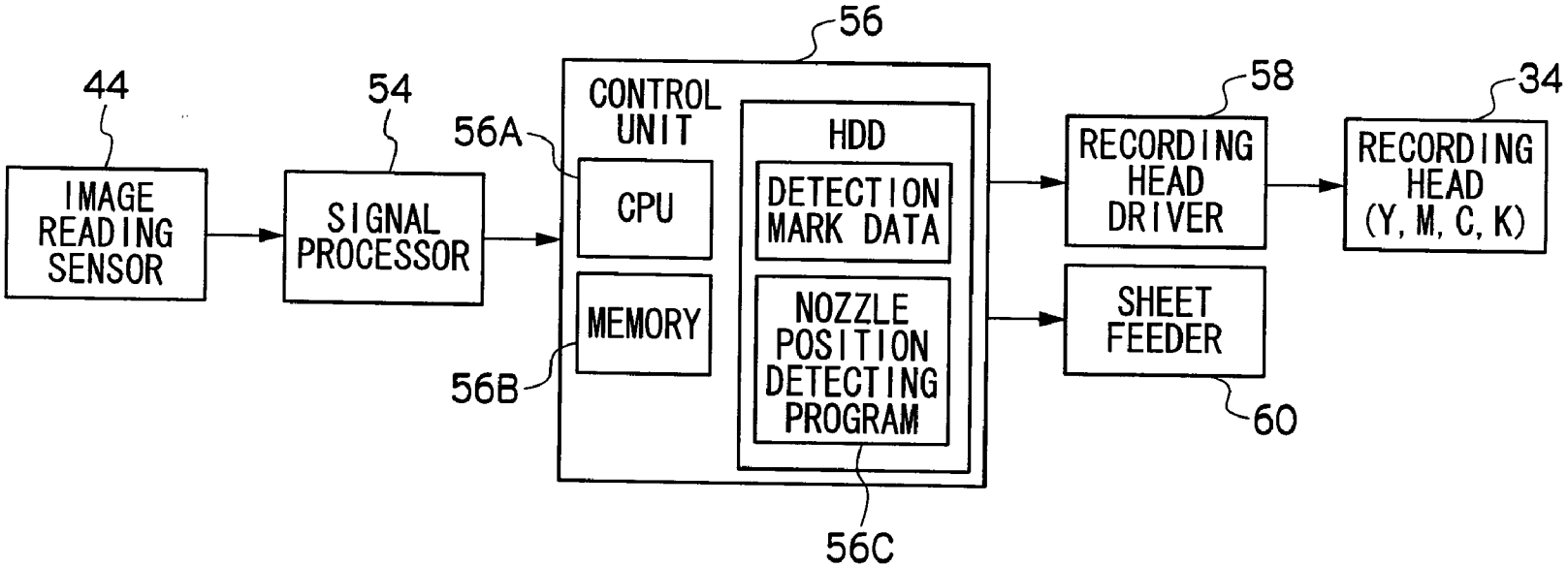
FIG. 3 is a block diagram schematically illustrating the connection relationship between a control unit and its peripheral equipment.

As illustrated in FIG. 3, each of the image sensor units 46 in the image sensor 44 is connected to a control unit 56 via a signal processor 54, which then receives the reading signal output from each of the image sensor units 46 in the image sensor 44. The signal processor 54 is constituted by including an amplifier, an A/D (analog/digital) converter and a memory capable of storing data on a plurality of lines therein, and therefore, amplifies the reading signal received from each of the image sensor units 46, converts the reading signal into reading data and stores the data in the memory in sequence. Since some of the plurality of image sensor units 46 constituting the image sensor 44 are displaced by the predetermined distance in the feed direction of the recording sheet in the present exemplary embodiment, as shown in FIG. 2, the signal processor 54 repeats, in the same cycle as the image reading cycle by the image sensor 44, operation of extracting the reading data on one line in the widthwise direction of the recording sheet from the reading data temporarily stored in the memory and outputting the extracted reading data on one line to the control unit 56.

The control unit 56 is provided with a CPU 56A, a memory 56B and an HDD (abbreviating "a Hard Disk Drive") 56C. Here, the HDD 56C may be replaced with another nonvolatile storage component such as a flash memory. The HDD 56C stores therein detection mark data for recording a detection mark, described later, on the recording sheet by the recording head 34, and further, previously installs therein a nozzle position detecting program (corresponding to "a position detecting program for a recording portion" according to the invention) for performing a nozzle position detecting processing, described later, by the CPU 56A.

Additionally, to the control unit 56 is connected the recording head 34 (i.e., the recording heads 34K, 34C, 34M and 34Y) via a recording head driver 58, and further, is connected also a sheet feeder 60 (which is constituted of the drive motor 26 or a motor serving as the rotationally driving component for rotationally driving each of the rolls). Furthermore, the control unit 56 is connected to a computer such as a PC (abbreviating "a Personal Computer") via a communication network such as a LAN (abbreviating "a Local Area Network") or a USB (abbreviating "a Universal Serial Bus") cable.

Next, explanation will be made on a function in the present exemplary embodiment. Upon receipt of the image data representing an image to be recorded on the recording sheet from the computer via the communication network, the control unit 56 converts the received image data into image data of each of the colors K, C, M and Y (i.e., image data representing an ink ejection amount of each of the colors K, C, M and Y for each of pixels of an image), and then, temporarily stores it in the HDD 56C, and further, controls the sheet feeder 60 in such a manner that the recording sheet is drawn from the sheet tray 12 and fed to the arrangement position of the recording head 34.

When the tip of the recording sheet which is fed at a constant speed by the conveyor belt 24 reaches the arrangement position of the recording head 34, the control unit 56 sequentially reads the image data on the colors K, C, M and Y stored in the HDD 56C per line in the widthwise direction of the recording sheet, and then, outputs them to the recording head driver 58 in sequence. The recording head driver 58 drives the recording heads 34K, 34C, 34M and 34Y in such a manner that the ink ejection or the ink ejection amount in the case of the ink ejection from each of the numerous nozzles disposed at each of the recording heads 34K, 34C, 34M and 34Y is switched in sequence in accordance with the image data on the colors sequentially input from the control unit 56 per line. Here, a drive timing of each of the recording heads 34K, 34C, 34M and 34Y is changed according to, in particular, a change in position of the recording heads 34K, 34C, 34M and 34Y in the feed direction of the recording sheet. As a consequence, a color image is formed on the recording sheet by forming images on the recording sheet fed in the arrangement position of the recording head 34 per line by the recording heads 34K, 34C, 34M and 34Y.

In the above-described configuration, in which the image is recorded by the use of the recording head 34 capable of recording one line from one end to the other end in the widthwise direction of the recording sheet in one ink ejection, the recording head need not be moved in the widthwise direction of the recording sheet, thereby producing an advantage that the image can be recorded on the recording sheet at a high speed. Here, in the configuration, the ink ejected from each of the nozzles (i.e., each of the recording portions) formed at the recording head 34 forms a dot at a predetermined position on the recording sheet in the widthwise direction of the recording sheet. Therefore, if any of the nozzles at the recording head 34 are non-ejection nozzles which cannot eject the ink caused by, for example, clogging with the ink, a streak of a low concentration is generated in the feed direction of the recording sheet, thereby raising a problem that the resultant image is liable to be visually observed as an image having a deficient quality.

Otherwise, it is necessary to grasp the position of each of the nozzles at the recording head 34 in the widthwise direction of the recording sheet (i.e., the position of the dot formed on the recording sheet by each of the nozzles at the recording head 34 in the widthwise direction of the recording sheet) in order to specify the nozzle at a specified position (e.g., a position at which the deficient quality of the image is generated) in the widthwise direction of the recording sheet when the deficient quality of the image caused by the generation of the non-ejection nozzle at the recording head 34 appears on the image recorded on the recording sheet. However, the position of each of the nozzles at the recording head 34 in the widthwise direction of the recording sheet may be possibly fluctuated by an influence of a change in ambient temperature. In the present exemplary embodiment, the pitch of the photoelectrically converting cells in the image sensor 44 is greater than that of the nozzles in the recording head 34, and therefore, the position of each of the nozzles at the recording head 34 in the widthwise direction of the recording sheet cannot be readily detected even with a result obtained by recording the predetermined mark on the recording sheet by each of the nozzles and reading it by the image sensor 44.

In view of this, in the present exemplary embodiment, the control unit 56 detects the position of each of the nozzles at the recording head 34 at the time of turning-on of a power source in the recording apparatus 10 or at a timing of a lapse of predetermined time after previous processing or the like (here, the processing may be performed at another timing when, for example, the ambient temperature is changed higher than a predetermined value). Hereinafter, a description will be given of the processing for detecting the position of each of the nozzles at the recording head 34, in sequence by beginning from the detection mark to be recorded on the recording sheet in order to detect the position of each of the nozzles.

Figure 4:
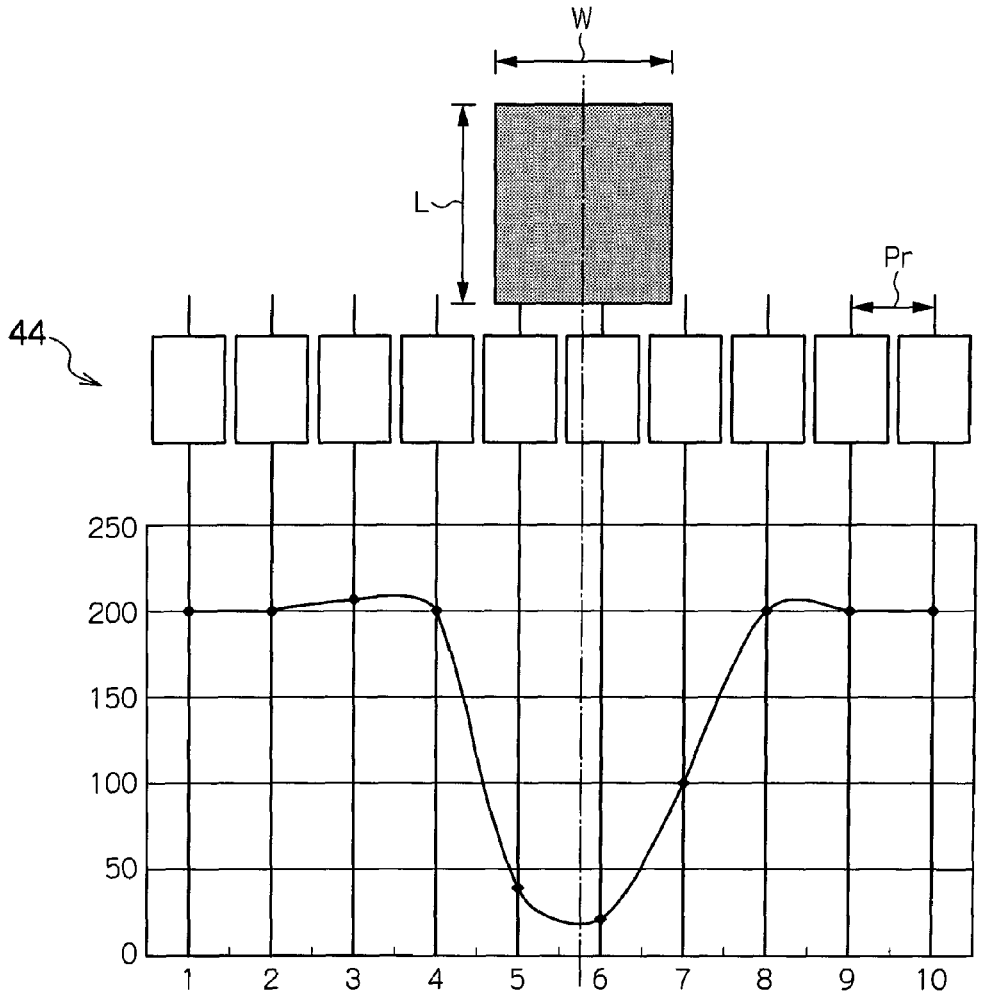
FIG. 4 is a conceptual diagram exemplifying a size of the detection mark and an output signal of the image sensor.

Although the particulars will be described later, the image sensor 44 reads the detection mark recorded on the recording sheet, calculates the barycenter position of the detection mark in the widthwise direction of the recording sheet based on the reading result of the detection mark, and thus, detects the position of the nozzle for use in recording the detection mark in the present exemplary embodiment. FIG. 4 exemplifies a size of the detection mark, a positional relationship between the image sensor 44 and the photoelectrically converting cell, and the reading signal output from each of the photoelectrically converting cells in the image sensor 44. In order to calculate the barycenter position of the detection mark in the widthwise direction of the recording sheet based on the reading result of the detection mark (i.e., the reading signal output from each of the photoelectrically converting cells in the image sensor 44), it is necessary to generate at least three photoelectrically converting cells having the reading signal changed due to the detection mark, as illustrated in FIG. 4. As a consequence, a size W (i.e., a width W) of the detection mark in the widthwise direction of the recording sheet (i.e., a first direction) is set twice or more than a pitch Pr of the photoelectrically converting cells in the image sensor 44 in the present exemplary embodiment. In this manner, the barycenter position of the detection mark in the widthwise direction of the recording sheet can be calculated based on the reading result of the detection mark.

Figure 5:
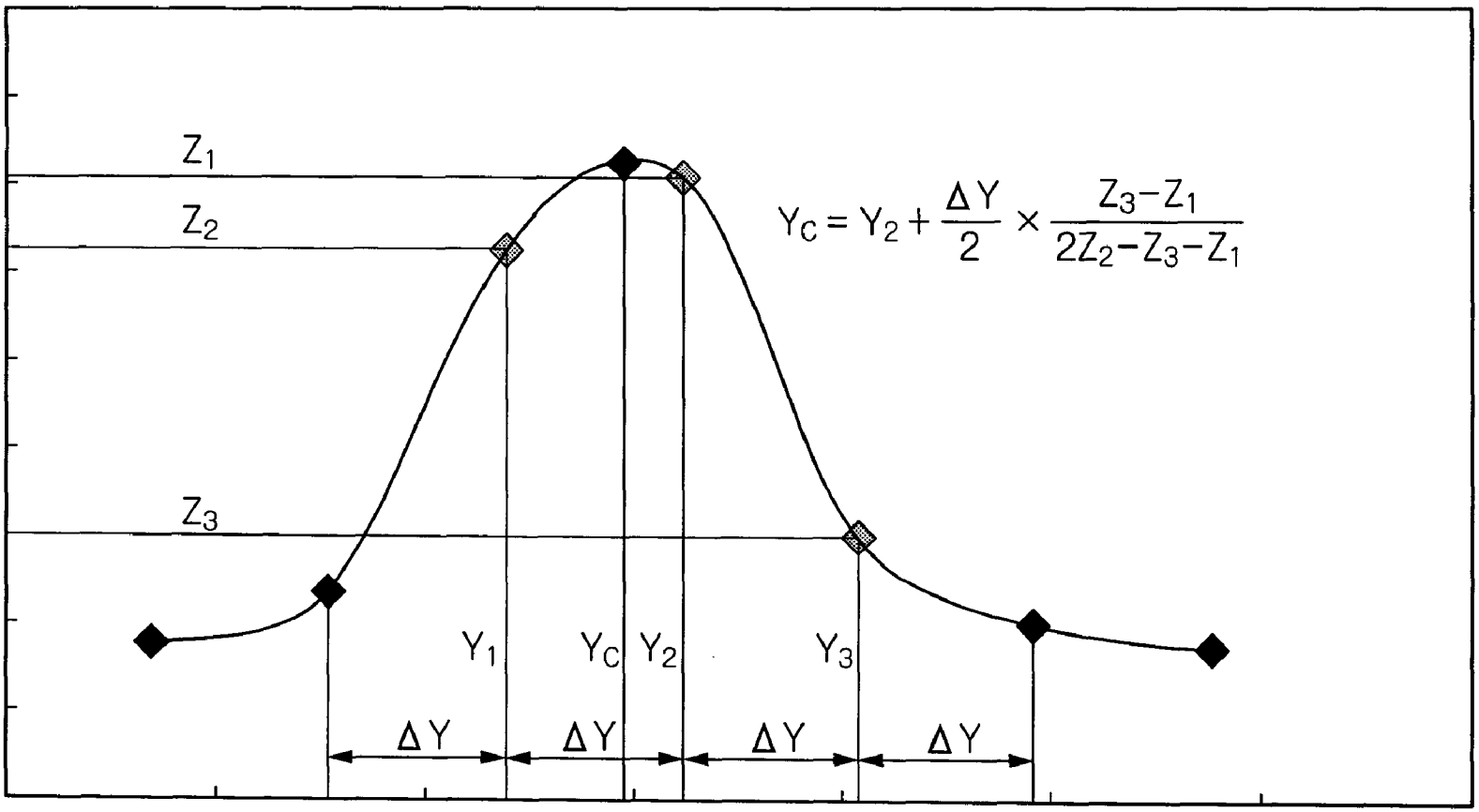
FIG. 5 is a graph explanatory of calculation of a barycenter position of the detection mark.

Alternatively, also as illustrated in FIG. 5, certain changes in shape are sampled per ΔY, and then, a barycenter position $Y_c$ of the change in shape can be obtained from the following equation:

$$Y_c = Y_2 + (\Delta Y/2) \times \{(Z_3 - Z_1)/(2Z_2 - Z_3 - Z_1)\} \quad (1)$$

where a value at $Y_1$ is $Z_2$; a value at $Y_2$ is $Z_1$; and a value at $Y_3$ is $Z_3$. The barycenter position of the detection mark can be calculated by using, for example, the above equation (1).

Moreover, the recording sheet having the detection mark recorded thereon is continuously fed also during reading the detection mark by the image sensor 44 in the present exemplary embodiment. Consequently, a size L (i.e., a length L) of the detection mark in the feed direction of the recording sheet (i.e., a second direction) is set in the present exemplary embodiment as the following inequality (2):

$$L \geqq (n+1) \cdot V \cdot T \quad (2)$$

(where n is an integer more than 1; V represents a feed speed of the recording sheet; and T expresses an image reading cycle (i.e., an electric charge accumulation time of the CCD sensor 52) by the image sensor 44). In this manner, a state in which the reading signal is being changed is continued for a period longer than the two image reading cycles in the two or three or more photoelectrically converting cells which change the reading signal due to the detection mark, and therefore, the state in which the reading signal in the photoelectrically converting cell is being changed is continued in at least one cycle from start to end of the image reading cycle.

Figure 6A:
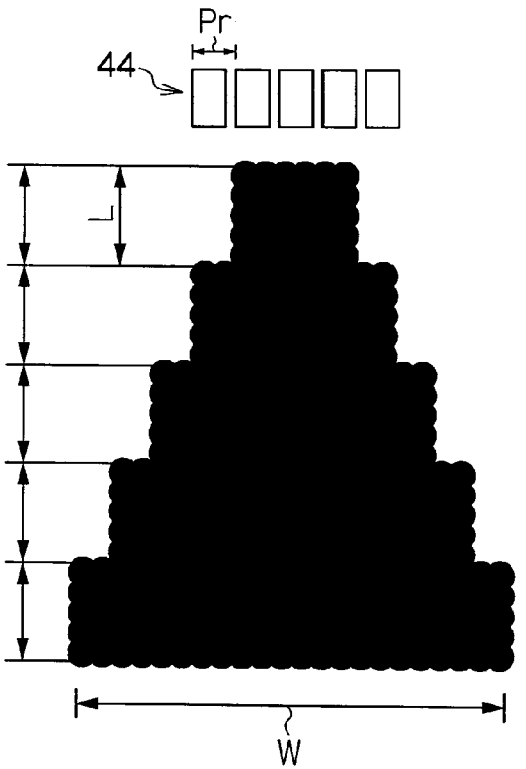
FIG. 6A is a conceptual diagram exemplifying the detection mark.

In the present exemplary embodiment, data representing a detection mark illustrated in FIG. 6A is stored in the HDD 56C in the control unit 56 as data on the detection mark to be recorded on the recording sheet by the recording head 34 for the purpose of the detection of the position of each of the nozzles at the recording head 34 based on the above-described condition with respect to the detection mark. As illustrated in FIG. 6A, the detection mark in the present exemplary embodiment satisfies the above-described condition with respect to the detection mark (i.e., the width W is twice or more than the pitch Pr of the photoelectrically converting cells in the image sensor 44 and the length L satisfies the inequality (2)). Furthermore, a plurality of types of marks whose width W are incremented by twice or more than the pitch Pr of the photoelectrically converting cells in the image sensor 44 accord with each other at barycenter positions in the widthwise direction of the recording sheet whereas they are brought into contact with each other in the feed direction of the recording sheet. In addition, the detection mark illustrated in FIG. 6A has the length L of each of the marks equivalent to a value obtained by setting the variable n expressed in the inequality (2) to 2 or more. In this way, during reading each of the marks of the detection mark, the state in which the reading signal is being changed in accordance with each of the marks is continued for a period longer than the (n+1) image reading cycles, and therefore, the state in which the reading signal is being changed in accordance with each of the marks is continued in the n cycles (i.e., two or more cycles) from start to end of the image reading cycle.

FIG. 6A exemplifies the detection mark according to the invention by a substantially triangular detection mark as a whole, but the detection mark is not limited to this. For example, the detection mark may be a substantially inverted triangle as a whole (i.e., a shape having a side corresponding to a bottom side of an isosceles triangle positioned upstream in the feed direction of the recording sheet) or a rhombus as a whole (two of the substantially triangular detection marks illustrated in FIG. 6A are arranged in such a manner that sides corresponding to bottom sides of isosceles triangles are adjacent to each other).

The control unit 56 reads detection mark data representing the detection mark from the HDD 56C, and further, selects and determines the plurality of nozzles whose positions are to be detected out of the nozzles formed at the recording head 34 when the detection mark is recorded on the recording sheet by the recording head 34. In consideration of possibility of fluctuations of a fixing position of each of the image reading sections 46 in the image sensor 44 within a tolerance, the nozzle whose position is to be detected can be selected, as illustrated in, for example, FIG. 2, such that two or more (two in FIG. 2) nozzles whose positions are to be detected are included within a reading region of each of the image reading sections 46 in the image sensor 44, that the two or more nozzles whose positions are to be detected are positioned at a substantially equal interval at a plurality of portions enclosing the vicinity of both ends of the reading region of the image reading section 46 (the nozzles are positioned only in the vicinity of both ends in FIG. 2), and further, that the detection mark never straddles across the boundary between the recording head units 36 (in such a manner that the fluctuation of the fixing position of each of the recording head units 36 within the tolerance never adversely influences the calculation of the barycenter position, described later). Subsequently, a plurality of detection mark recording image data arranged in the widthwise direction of the recording sheet are produced such that a dot array at a center in the widthwise direction of the recording sheet out of the detection marks represented by the read detection mark data is recorded by the previously selected nozzle whose position is to be detected (see FIG. 2).

And then, the recording sheet is fed by the conveyor belt 24 at the constant speed. In a state in which the tip of the recording sheet reaches the arrangement position of the recording head 34 or the recording sheet is fed by a predetermined distance after the tip of the recording sheet reaches the arrangement position of the recording head 34, the produced detection mark recording image data are output in sequence to the recording head driver 58 per line. As a consequence, the detection marks are recorded at the plurality of portions, respectively, on the recording sheet in the widthwise direction of the recording sheet by the recording head 34. Here, the detection marks are recorded at the plurality of portions on the recording sheet by the recording heads 34K, 34C, 34M and 34Y, which also control a recording timing of the detection mark on the recording sheet in such a manner that the detection marks recorded by the recording heads 34K, 34C, 34M and 34Y cannot overlap on the recording sheet.

Figure 7:
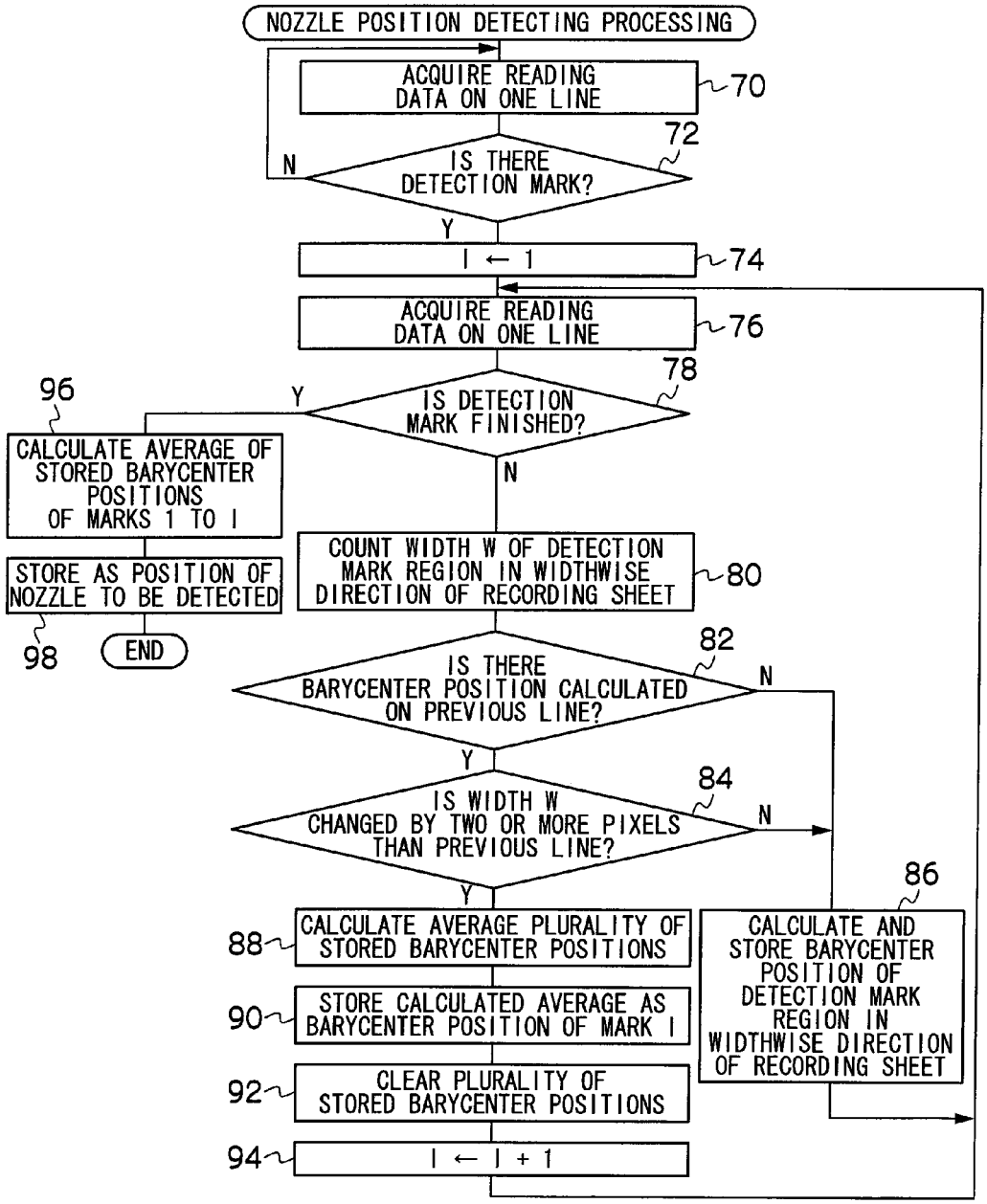
FIG. 7 is a flowchart illustrating the contents of a nozzle position detecting processing.

In the meantime, when the recording sheet having the detection marks recorded at the plurality of portions thereon reaches the arrangement position of the image sensor 44, the control unit 56 executes a nozzle position detecting program in the CPU 56A, so as to implement a nozzle position detecting processing illustrated in FIG. 7. Here, FIG. 7 illustrates processing with respect to a single detection mark recorded on the recording sheet, but the plurality of detection marks are recorded on the recording sheet by the recording heads 34K, 34C, 34M and 34Y, and therefore, the processing illustrated in FIG. 7 is actually performed with respect to each of the detection marks.

In the nozzle position detecting processing illustrated in FIG. 7, first, the reading data on one line representing the result read by the image sensor 44 in a certain reading cycle is acquired from the image sensor 44 via the signal processor 54 in step 70. In next step 72, it is determined as to whether or not there is a portion whose received light amount is changed in excess of a threshold corresponding to the detection mark in the reading data acquired in step 70. If the determination is negative, the control routine returns to step 70. The control routine in steps 70 and 72 is repeated until the determination in step 72 becomes affirmative. When the tip of the portion at which the detection mark is recorded on the recording sheet (i.e., the end upstream in the feed direction of the recording sheet) reaches the reading region of the image sensor 44, the determination in step 72 is affirmative. Thereafter, the control routine proceeds to step 74, in which an initial value 1 is substituted into a variable i.

In step 76, another reading data on one line representing the result read by the image sensor 44 (i.e., reading data on a line subsequent to the previously acquired reading data) in a reading cycle subsequent to that of the previously acquired reading data is acquired from the image sensor 44 via the signal processor 54. In next step 78, it is determined as to whether or not a trail of a detection mark region (i.e., a region in which the detection mark is recorded on the recording sheet) completely passes the arrangement position of the image sensor 44 by determining as to whether or not there is a portion whose received light amount is changed in excess of a threshold corresponding to the detection mark in the reading data acquired in step 76.

If the determination is negative in step 78, the control routine proceeds to step 80, the number of pixels changed in value corresponding to the detection mark region in the reading data on one line (i.e., the number of photoelectrically converting cells in the image sensor 44) is counted as the width W of the detection mark region. Here, in the present exemplary embodiment, the width W of the detection mark is set to twice or more than the pitch Pr between the photoelectrically converting cells in the image sensor 44, and therefore, the number of pixels counted in step 80 becomes three or more. It is determined in step 82 as to whether or not the barycenter position of the detection mark region calculated in the previous cycle (i.e., the previous line) is stored in the memory 56B. In this case, the determination is negative, and then, the control routine proceeds to step 86, in which the barycenter position of the detection mark region (specifically, the barycenter position of a region corresponding to a mark i out of the detection mark in the widthwise direction of the recording sheet) is calculated by substituting the value of the pixels (the three or more pixels changed in value corresponding to the detection mark region counted in step 80) corresponding to the detection mark region out of the reading data on one line acquired in step 76 into the above-described equation (1) (here, the pitch Pr between the photoelectrically converting cells in the image sensor 44 may be used as $\Delta Y$ in the equation (1)), followed by storing the calculation result of the barycenter position in the memory 56B. Thereafter, the control routine returns to step 76.

In this manner, the reading data on one line representing the result read by the image sensor 44 in the preceding reading cycle is acquired in step 76, and thereafter, the determination is performed again in step 82 through steps 78 and 80. In this case, since the calculation result of the barycenter position of the detection mark region has been already stored in the memory 56B, the determination in step 82 is affirmative, and therefore, the control routine proceeds to step 84. It is determined in step 84 as to whether or not the width W of the detection mark region counted in the previous step 80 is changed by two or more pixels in the image sensor 44 in comparison with the width W of the detection mark region calculated in the previous cycle (i.e., the width W of the detection mark region on the previous line) (in other words, whether or not it is changed twice or more than the pitch Pr between the photoelectrically converting cells in the image sensor 44). Also if the determination in step 84 is negative, the control routine proceeds to step 86, in which the barycenter position of the detection mark region (specifically, the barycenter position of the region corresponding to the mark i in the widthwise direction of the recording sheet) is calculated, followed by storing the calculation result of the barycenter position in the memory 56B, as described above. Thereafter, the control routine returns to step 76. In this manner, until the determination in step 84 becomes affirmative, the barycenter position of the detection mark region in the widthwise direction of the recording sheet is repeatedly calculated and stored based on the reading data acquired in each of the reading cycles.

Incidentally, as illustrated also in FIG. 6A, although the detection mark in the present exemplary embodiment has a somewhat large maximum value of the width W, also in the case where the nozzle positioned at the end in the widthwise direction of the recording sheet is selected as the nozzle whose position is to be detected out of the nozzles which are arranged on the recording head 34 and can be selected as one whose position is to be detected in the present exemplary embodiment, the image sensor 44 is disposed in such a manner that the photoelectrically converting cells are located by the pitch Pr between the photoelectrically converting cells in the image sensor 44 or more outside of the end of the detection mark formed and recorded by regarding the position of the nozzle as a reference (i.e., a center) in the widthwise direction of the recording sheet. As a consequence, also in the case where the nozzle positioned at the end is selected as one whose position is to be detected, the barycenter position of the detection mark in the widthwise direction of the recording sheet can be calculated with secured accuracy.

On the other hand, the boundary between the plurality of marks constituting the detection mark (the width W of the detection mark in the widthwise direction of the recording sheet is increased by twice or more than the pitch Pr between the photoelectrically converting cells in the image sensor 44) is read by the image sensor 44, and then, reading data corresponding to the reading result of the boundary is acquired in step 76. Here, the determination in step 84 is affirmative, and thereafter, the control routine proceeds to step 88. At this time, the calculation result of the barycenter position of the mark i of the detection mark in the widthwise direction of the recording sheet is stored in the memory 56B in the same number as n in the above-described inequality (2). An average of the plurality of barycenter positions stored in the memory 56B is calculated in step 88, and then, the calculated average of the barycenter positions is stored in the memory 56B as the barycenter position of the mark i in next step 90. In this way, the barycenter positions of the marks i in the widthwise direction of the recording sheet are calculated from the n reading data obtained by reading in the n image reading cycles in which the state in which the reading signal is varied according to the mark i is continued from start to end of the image reading cycle, and thereafter, the average is stored in the memory 56B as the barycenter position of the mark i in the widthwise direction of the recording sheet. In next step 92, the n barycenter positions calculated and stored in the memory 56B in step 86 are cleared from the memory 56B. The variable i is incremented by 1 in step 94, and thereafter, the control routine returns to step 76. Steps 76 to 94 are repeated until the determination in step 78 is affirmative.

With the above-described processing, the reading data in the cycle in which the determination in step 72 or 84 is affirmative (the reading data representing the reading result of the tip of the detection mark or the reading data representing the reading result of the boundary between the plurality of marks constituting the detection mark) is discarded without any use for the detection of the position of the nozzle on the recording head 34. Additionally, every time the determination in step 72 or 84 is affirmative (every time the tip of the detection mark is detected or the width W of the detection mark is varied by twice or more than the pitch Pr between the photoelectrically converting cells in the image sensor 44), the reading data in the continuous n image reading cycles subsequent to that (the reading data representing the reading result in the image reading cycles in which the state in which the reading signal is varied according to the mark i is continued from start to end of the image reading cycle) are used in calculating the barycenter position of the mark i in the widthwise direction of the recording sheet, and finally, the average is stored as the barycenter position of the mark i.

When the determination in step 78 is affirmative, the control routine proceeds to step 96, in which the average of the barycenter positions of the marks 1 to i in the widthwise direction of the recording sheet, stored in the memory 56B is calculated as the barycenter position of the detection mark in the widthwise direction of the recording sheet. In step 98, the barycenter position of the detection mark calculated in step 96 in the widthwise direction of the recording sheet is stored in the memory 56B or the HDD 56C as the position of the nozzle whose position to be detected. Thus, the nozzle position detecting processing comes to an end.

Figure 6B:
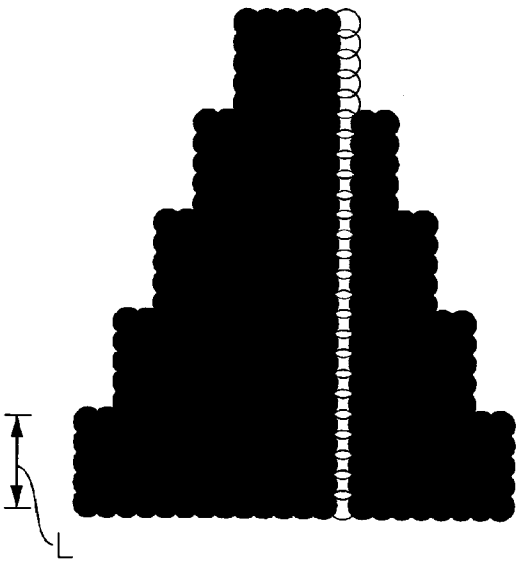
FIGS. 6B and 6C are conceptual diagrams illustrating variations of the detection mark in the case where there is a non-ejection nozzle.
Figure 6C:
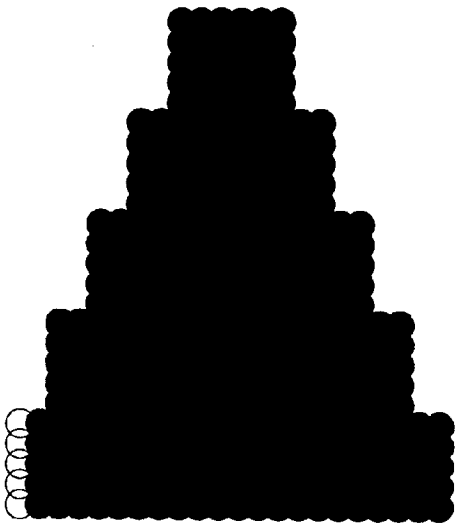

In the case where the non-ejection nozzle is included in mixture in the nozzles for use in recording the detection mark, a streak of a low concentration is generated in the feed direction of the recording sheet on a part of the detection mark recorded on the recording sheet, as illustrated in, for example, FIGS. 6B and 6C. If the streak of a low concentration is located at the end of the detection mark, an error occurs in the calculation result of the barycenter position of the detection mark. To the contrary, the detection mark formed of the plurality of marks different in width W from each other, as described above, is recorded on the recording sheet, the barycenter positions of the marks are calculated, and the average is regarded as the barycenter position of the detection mark, thereby alleviating the adverse influence even if the non-ejection nozzle is included in mixture in the nozzles for use in recording the detection mark.

The above-described nozzle position detecting processing is performed with respect to the plurality of detection marks recorded at portions different from each other (the plurality of nozzles whose positions are different from each other are to be detected). In this way, the positions of the plurality of nozzles whose positions are to be detected can be known. The positions of the other nozzles formed at the recording head are calculated by interpolation (or extrapolation) based on the positions of the plurality of nozzles which have been known already. Consequently, since all of the positions of the nozzles at the recording head 34 are known, the non-ejection nozzle can be specified without any delay based on the image reading result by the image sensor 44 (i.e., the position of the streak of the low concentration) even if the non-ejection nozzle appears at the recording head 34.

Incidentally, although the recording component according to the invention has been exemplified above by the recording head 34 for recording the image on the recording sheet by ejecting the ink by the ink jet system, the invention is not limited to this. For example, the invention may be applicable to the recording component adopting other configurations for recording an electrostatic latent image on a photosensitive member by exposure from an LED light source having numerous LEDs aligned therein, and then, recording an image by an electrophotographic system.

Alternatively, although the explanation has been made on the mode in which the nozzle position detecting program corresponding to the position detecting program for the recording portion according to the invention has been previously stored (i.e., installed) in the HDD 56C in the control unit 56, the position detecting program for the recording portion according to the invention may be provided in a mode in which it may be recorded on a recording medium such as a CD-ROM or a DVD-ROM.

What is claimed is:

1. A recording apparatus comprising:

a recording component that includes a plurality of recording portions arranged in a first direction and moves relatively to a recording medium at a speed V in a second direction intersecting with the first direction;

a reading component that reads an image recorded on the recording medium by the recording component in a reading cycle T by a plurality of reading sections arranged at a predetermined pitch in the first direction; and a control component that controls, on the recording medium by the recording component, recordation of a detection mark having a size W in the first direction of twice or more than twice the predetermined pitch and a size L in the second direction in which $L \geqq (n+1) \cdot V \cdot T$ (where n is an integer of 1 or more) and calculate a barycenter position of the detection mark in the first direction based on a reading result of the detection mark by the reading component.

2. The recording apparatus of claim 1, wherein the control component calculates the barycenter position of the detection mark in the first direction by setting the size L of the detection mark to be recorded on the recording medium by the recording component to be a size that is equivalent to setting the integer n to be 2 or more and averaging the barycenter positions of the detection marks in the first direction based on the reading results of the detection mark in n reading cycles by the reading component.

3. The recording apparatus of claim 2, wherein the control component calculates the barycenter position of the detection mark in the first direction by using the reading results by the reading component in n reading cycles continuous from a cycle subsequent to a reading cycle in which the reading result by the reading component varies by a predetermined value or more.

4. The recording apparatus of claim 1, wherein the control component calculates the barycenter position of a detection mark group consisting of a plurality of types of detection marks in the first direction by sequentially recording, on the recording medium, the plurality of types of detection marks having the sizes W different from each other by twice or more than twice the predetermined pitch by the recording component in such a manner that the barycenter positions of the detection marks accord with each other in the first direction, respectively, and determining and averaging the barycenter positions of the plurality of types of detection marks in the first direction based on the reading results of the plurality of types of detection marks by the reading component.

5. The recording apparatus of claim 4, wherein the control component calculates the barycenter positions of the plurality of types of detection marks in the first direction by sequentially recording, on the recording medium, the plurality of types of detection marks by the recording component in such a manner that the plurality of types of detection marks are adjacent to each other on the recording medium in the second direction, and calculating the barycenter position of the detection mark in the first direction by using the reading results by the reading component in n reading cycles continuous from a next cycle every time the size W of the detection mark indicated by the reading result by the reading component varies by the predetermined pitch or more.

6. The recording apparatus of claim 1, wherein:

the recording component is constituted by aligning, in the first direction, a plurality of recording units, each having the plurality of recording portions arranged in the first direction; and the control component causes the recording component to record the detection mark on the recording medium in such a manner that the detection mark does not straddle the boundary between the plurality of recording units in the first direction.

7. The recording apparatus of claim 1, wherein:

the control component causes a recording portion that is to be detected and recording portions arranged in the same number on both sides in the first direction continuous from the recording portion that is to be detected among the plurality of recording portions in the recording component to record the detection mark and calculates the barycenter position of the detection mark in the first direction, so as to detect the position of the recording portion that is to be detected in the first direction; and the reading component is disposed such that a reading section existing at an end in the first direction among the plurality of reading sections is positioned by the predetermined pitch or more outside of the recording portion positioned outermost in the first direction among the recording portions that are to be detected in the recording component.

8. The recording apparatus of claim 7, wherein the reading component is constituted by aligning, at positions different from each other in the first direction, a plurality of reading sections, each having the plurality of reading sections arranged in the first direction; and the control component determines the recording portion to be detected in such a manner that the two or more detection marks are recorded within a reading region of each of the reading units.

9. A position detecting method for a recording portion in a recording apparatus, the recording apparatus including:

a recording component that includes a plurality of recording portions arranged in a first direction and moves relatively to a recording medium at a speed V in a second direction intersecting with the first direction; and a reading component that reads an image recorded on the recording medium by the recording component in a reading cycle T by a plurality of reading sections arranged at a predetermined pitch in the first direction; and the position detecting method for a recording portion comprising:

recording on the recording medium by the recording component a detection mark having a size W in the first direction of twice or more than twice the predetermined pitch and a size L in the second direction in which $L \geqq (n+1) \cdot V \cdot T$ (where n is an integer of 1 or more); and calculating a barycenter position of the detection mark in the first direction based on a reading result of the detection mark by the reading component.

10. The position detecting method for a recording portion of claim 9, wherein the barycenter position of the detection mark in the first direction is calculated by setting the size L of the detection mark to be recorded on the recording medium by the recording component to be a size that is equivalent to setting the integer n to be 2 or more and averaging the barycenter positions of the detection marks in the first direction based on the reading results of the detection mark in n reading cycles by the reading component.

11. The position detecting method for a recording portion of claim 10, wherein the barycenter position of the detection mark in the first direction is calculated by using the reading result by the reading component in n reading cycles continuous from a cycle subsequent to a reading cycle in which the reading result by the reading component varies by a predetermined value or more.

12. The position detecting method for a recording portion of claim 9, wherein the barycenter position of a detection mark group consisting of a plurality of types of detection marks in the first direction is calculated by sequentially recording, on the recording medium, the plurality of types of detection marks having the sizes W different from each other by twice or more than twice the predetermined pitch by the recording component in such a manner that the barycenter positions of the detection marks accord with each other in the first direction, respectively, and determining and averaging the barycenter positions of the plurality of types of detection marks in the first direction based on the reading results of the plurality of types of detection marks by the reading component.

13. The position detecting method for a recording portion of claim 9, wherein:

the recording component is constituted by aligning, in the first direction, a plurality of recording units, each having the plurality of recording portions arranged in the first direction; and the detection mark is recorded on the recording medium by the recording component in such a manner that the detection mark does not straddle the boundary between the plurality of recording units in the first direction.

14. The position detecting method for a recording portion of claim 9, wherein:

the detection mark is recorded by a recording portion that is to be detected and recording portions arranged in the same number on both sides in the first direction continuous from the recording portion that is to be detected among the plurality of recording portions in the recording component, and further, the position of the recording portion that is to be detected in the first direction is detected by calculating the barycenter position of the detection mark in the first direction; and the reading component is disposed such that a reading section existing at an end in the first direction among the plurality of reading sections is positioned by the predetermined pitch or more outside of the recording portion positioned outermost in the first direction among the recording portions that are to be detected in the recording component.

15. A non-transitory storage medium readable by a computer, the computer being incorporated in a recording apparatus or connected to the recording apparatus, the recording apparatus including:

a recording component that includes a plurality of recording portions arranged in a first direction and moves relatively to a recording medium at a speed V in a second direction intersecting with the first direction; and a reading component that reads an image recorded on the recording medium by the recording component in a reading cycle T by a plurality of reading sections arranged at a predetermined pitch in the first direction;

the storage medium storing a program of instructions executable by the computer to perform a function for detecting a position of a recording portion, the function comprising:

recording on the recording medium by the recording component a detection mark having a size W in the first direction of twice or more than twice the predetermined pitch and a size L in the second direction in which $L \geqq (n+1) \cdot V \cdot T$ (where n is an integer of 1 or more); and calculating a barycenter position of the detection mark in the first direction based on a reading result of the detection mark by the reading component.

16. The storage medium of claim 15, wherein the barycenter position of the detection mark in the first direction is calculated by setting the size L of the detection mark to be recorded on the recording medium by the recording component to be a size that is equivalent to setting the integer n to be 2 or more and averaging the barycenter positions of the detection marks in the first direction based on the reading results of the detection mark in n reading cycles by the reading component.

17. The storage medium of claim 16, wherein the barycenter position of the detection mark in the first direction is calculated by using the reading result by the reading component in n reading cycles continuous from a cycle subsequent to a reading cycle in which the reading result by the reading component varies by a predetermined value or more.

18. The storage medium of claim 15, wherein the barycenter position of a detection mark group consisting of a plurality of types of detection marks in the first direction is calculated by sequentially recording, on the recording medium, the plurality of types of detection marks having the sizes W different from each other by twice or more than twice the predetermined pitch by the recording component in such a manner that the barycenter positions of the detection marks accord with each other in the first direction, respectively, and determining and averaging the barycenter positions of the plurality of types of detection marks in the first direction based on the reading results of the plurality of types of detection marks by the reading component.

19. The storage medium of claim 15, wherein:

the recording component is constituted by aligning, in the first direction, a plurality of recording units, each having the plurality of recording portions arranged in the first direction; and the detection mark is recorded on the recording medium by the recording component in such a manner that the detection mark does not straddle the boundary between the plurality of recording units in the first direction.

20. The storage medium of claim 15, wherein:

the detection mark is recorded by a recording portion to be detected and recording portions arranged in the same number on both sides in the first direction continuous from the recording portion that is to be detected among the plurality of recording portions in the recording component, and further, the position of the recording portion that is to be detected in the first direction is detected by calculating the barycenter position of the detection mark in the first direction; and the reading component is disposed such that a reading section existing at an end in the first direction among the plurality of reading sections is positioned by the predetermined pitch or more outside of the recording portion positioned outermost in the first direction among the recording portions that are to be detected in the recording component.

* * * * *